United States Patent [19]

Adee et al.

[11] Patent Number: 4,612,737

[45] Date of Patent: Sep. 23, 1986

[54] GRIT BLAST DRILLING OF ADVANCED COMPOSITE PERFORATED SHEET

[75] Inventors: James M. Adee, San Diego; John A. Frye, Spring Valley, both of Calif.

[73] Assignee: Rohr Industries, Inc., Chula Vista, Calif.

[21] Appl. No.: 752,088

[22] Filed: Jul. 5, 1985

[51] Int. Cl.[4] ..... B24C 1/04

[52] U.S. Cl. ..... 51/310; 51/319

[58] Field of Search ..... 51/310, 311, 312, 319, 51/410, 413

[56] References Cited

U.S. PATENT DOCUMENTS 2,358,710 6/1941 Helgeson ..... 51/312

FOREIGN PATENT DOCUMENTS 53-67977 6/1978 Japan ..... 51/310

*Primary Examiner*—Frederick R. Schmidt
*Assistant Examiner*—Maurina Rachuba
*Attorney, Agent, or Firm*—P. J. Schlesinger; F. D. Gilliam

[57] ABSTRACT

A method and resulting product produced by attaching a prepared maskant of a desired perforation pattern to cured compound contoured or flat advanced composite materials, directing a narrow stream of highly abrasive grit material of a selected particle size range through a relatively large nozzle under selected high pressure toward the maskant perforations at a very small angle relative to the perforation walls until perforations are formed in the advanced composite material according to the stencil perforation pattern. The perforated sheet produced is particularly adapted for use in sound attenuation structures.

10 Claims, 11 Drawing Figures

GRIT BLAST DRILLING OF ADVANCED COMPOSITE PERFORATED SHEET

BACKGROUND OF THE INVENTION

The invention is generally directed to the field of sand blasting specific patterns by use of a preformed maskant and more particularly, but not by way of limitation, to the grit drilling of perforated patterns having a constant hole and spacing pattern in advanced composite materials used for aircraft acoustic structures having compound contoured surfaces.

The state of the art in sound attenuation structures for aircraft engine nacelles is represented by U.S. Pat. No. 4,254,171. This patent discloses a broad band noise attenuation panel that comprises an imperforate backing sheet, a cellular core adhesively bonded to the said backing sheet and to a perforate face sheet having a plurality of small perforations arranged in a predetermined spacing pattern. A microporous wire cloth is then adhesively bonded to the perforate sheet. Since this sound attenuation structure is used in connection with aircraft engine nacelles, it is made in arcuate and compound curved shapes to accommodate the dimensions and lines of the engine inlet and fan duct surfaces.

In the structure of U.S. Pat. No. 4,254,171, the elements would characteristically be made of metal with the perforated face sheet being typically made from aluminum. In view of the stress being placed in modern day aircraft design to reduce weight it is desired to replace as many of the elements of the subject acoustic structure with advanced composite materials thereby reducing weight without reducing strength.

Prior to the present invention, attempts at making a perforated sheet from cured imperforate advanced composite materials had been unsuccessful. As opposed to applications which involve cutting large artistic designs in an imperforate sheet the present application is unique in that it involves providing relatively small apertures, on the order of 0.030 to 0.125 inch, diameter typically arranged in a square or triangular pattern having a predetermined spacing so as to then provide a percent of open area (POA) to satisfy structural and/or acoustic requirements.

Adding to the difficulty of providing the required advanced composite perforate sheet is the fact that advanced composite sheets are relatively soft in an uncured condition and are relatively hard in a cured state and are cured into a desired arcuate or compound contoured shape by the application of required heat and pressure while the sheet is held in appropriate tooling within a vacuum bag that is positioned within a suitable autoclave.

Drilling the perforations in a cured advanced composite sheet was tried but was unsuccessful. In addition to having to deal with a curved surface which made the procedure very expensive to pursue, it was found that drilling can cause microfractures and scouring in the material at the hole sidewall and thus reduce the strength of the material to an unacceptable level.

Pin molding of the perforations directly into the composite material has been successfully accomplished for relatively large holes with low POA and flat or gently contoured surfaces. However, tooling costs can be prohibitive and material penetration/removal difficult for large compound contour parts with smaller holes and higher POA.

Laser drilling was also tried but was undesirable due to crazing microcracking at the hole sidewall caused by the heat affected zone radiating from the drilled holes. Attempts to provide the requisite apertures by a punching operation were equally unsuccessful since the punching operation was found to induce microfractures and tearing of composite fiber bundles resulting in an unacceptable reduction in material strength.

Thus, until the provision of the present invention no method had been discovered which would satisfactorily provide the required perforation pattern in relatively large parts at reasonable cost without degrading other characteristics of the material to an unacceptable level.

The prior art teaches the use of stencils with sandblasting for producing duplicates which are typically flowers or other artistic or fanciful designs, or written or printed material or designs as applicable to the marking of gravestones, decorative wall murals, commercial business signs and the like. There is no teaching regarding gas propelled abrasive blasting to provide through cutting of resin matrix based composite materials, such as graphite fiber/epoxy resin, graphite fiber/polyimide resin, glass fiber/epoxy resin, carbon/carbon and the like where the resulting perforated material is used for light-weight structural or structural and acoustic applications. The prior art focuses on flat surfaces whereas the present invention includes complex compound contour surfaces.

In U.S. Pat. No. 767,362, issued to E. C. Phillips in Aug. 9, 1904, titled "Process of Perforating Music Sheets" is a typical example of the use of a stencil as a guide to perforate limp music sheets (player piano and the like rolls). Thin, limp, easily cut material, (paper or the like) typically in roll form of constant width, is perforated by passing the sheet, covered with a nonadhering annular pattern web, over a flanged rotating cylindrical impact drum or roller using mechanical devices (analogous to a motion picture projector film tension roller mechanism) to retain the pattern web and pliable material in contact against each other and pressed against the impact drum. While passing over the drum, the pattern web is blasted with an air and sand mixture to perforate the limp material. The reference teaches a fan type nozzle for emitting the air and sand in a wide but narrow pattern to cover the width of the music sheet which results in the abrasive media impacting the pliable material at different angles, approximately 90° to the material surface directly above the center line of the nozzle and approaching 60° to the material surface at the outer edge of the nozzle. With a thin limp soft material, such as paper or the like, the varying angle of abrasive impact will have no effect on the shape of the perforation through a thin material. However, with thicker material, such as an advanced composite material formed from cured graphite fibers, polyimide resin or epoxy resin and the like, the fan type nozzle and resulting abrasive impact angles will provide straight through perforations only directly below the nozzle center line. At the fan edges, the perforation side walls will be perforated at the same angle as the abrasive impact angles producing angled perforations which are tapered and elliptical rather than round as provided directly beneath the nozzle centerline. In addition the teaching is not suitable for relatively rigid large flat or contoured shapes of varying size.

The U.S. Pat. No. 2,358,710 issued to Harold R. Helgeson on Sept. 19, 1944, titled "Sandblast Stencil and Method of Making Same", teaches that it is known to clamp a reinforced stencil on a workpiece for sandblasting the stencil design upon work surfaces and the like. This teaching is limited to sandblasting artistic designs onto the surface of the typically flat workpiece. There are no teachings for the formation of perforations through the workpiece by this method.

In a similar manner U.S. Pat. No. 2,791,289 issued May 7, 1957 entitled "Process of Forming Fissured Fiber Acoustical Tile and Products Thereof" teaches the use of stencil and sandblasting to form a random pattern of irregular shapes into (but specifically not through) low density, flat, fibrous, acoustical tile for non-structural acoustic treatment of residential and commercial buildings.

S. S. White Industrial Products Div., of Pennwalt Corporation, manufactures and distributes abrasive jet machining equipment suited to cutting, drilling, marking, and etching of glassware or the like. This equipment utilizes small nozzles in the orifice size range of from 0.005" to 0.045". Nozzles of this configuration are used as described to typically produce fanciful designs on glass and clean deburr or trim, small devices such as threaded fasteners, electrical components and the like. This type of teaching is limited to small nozzles and/or very fine abrasive, typically 10–50 microns in size, with low abrasive feed rates typically less than 50 grams per minutes which can not produce an acceptable industrial cutting speed for producing a multitude of holes in large parts.

Thus, there has not been an entirely satisfactory method known, either in the aerospace industry or in the art of stencilling for perforating composite materials and the like having a thickness of approximately 0.015" or greater until the emergence of the instant invention.

SUMMARY OF THE INVENTION

This invention is directed to relatively rapid perforating of rigid or semi-rigid materials subject to particle impact erosion including resin matrix fiber reinforced advanced composites in specific non-continuous, flat, contoured or compound contoured geometric shapes to be used as standard load carrying elements including but not limited to aircraft nacelle acoustic components and space system components.

An object of the invention is to produce perforations having a relatively small diameter with close spacing in a predetermined regular spacing pattern through contoured, compound contoured or flat material according to the patterns on a maskant affixed thereto in a precise manner.

Another object of the invention is to perforate thicker than music paper composite structures by grit blasting means whereby substantially parallel walled apertures are formed according to a maskant overlay.

Still another object of the invention is to produce precision, perforated, contoured, compound contoured or flat composite material at low cost with a minimum of waste for use as structural or structural and acoustic material or the like.

These and other objects and novel features of the invention will be more clearly and fully set forth in the following specification and claims.

DETAILED DESCRIPTION OF THE EMBODIMENT

Figure 1:
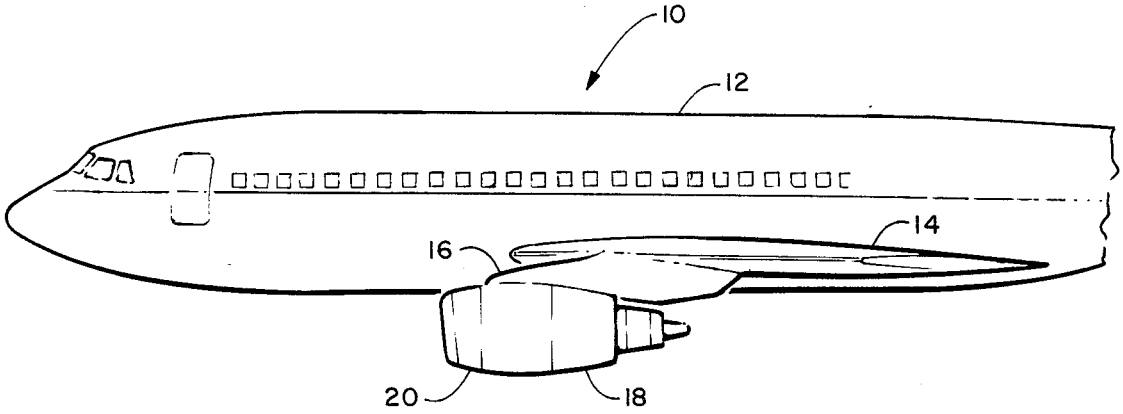
FIG. 1 is a partial view of an aircraft having engine nacelles that utilize sound attenuation structure having perforated advanced composite sheet incorporated therein made by use of the present invention.

Referring to the drawings in detail, and in particular to FIG. 1, reference character 10 generally refers to a commercial jet aircraft that is provided with a longitudinally extending fuselage 12 to which are attached transversely extending wing structures 14. Struts 16 depend downwardly and forwardly from the wings 14 to support suitable propulsion systems 18. The propulsion system 18 comprises a large bypass fan type aircraft engine that is surrounded by a nacelle system 20 as seen in FIG. 2.

Figure 2:
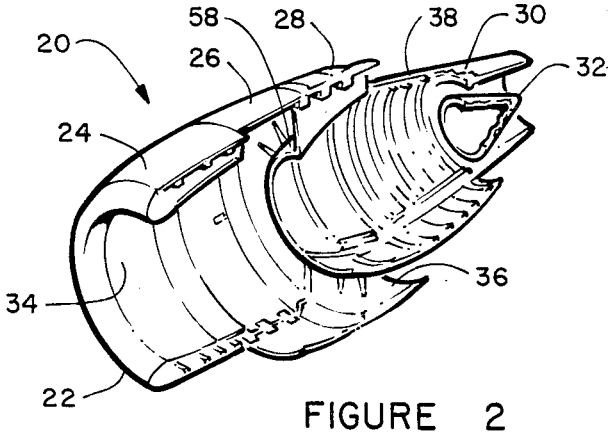
FIG. 2 is a partial cutaway perspective of a portion of the nacelle of FIG. 1 and illustrates typical arcuate and compound curved acoustic structure using perforate sheet made by use of the instant invention.

The nacelle system 20 is shown in FIG. 2 separate from the engine for ease of illustration. The nacelle system 20 includes generally a nose cowl 22, an inlet cowl 24, a fan cowl 26, a thrust reverser 28, a core cowl 30, and a plug 32. The arcuate inner surface 34 of the nose cowl 24, the inner arcuate surface 36 of the thrust reverser, and portion 38 of the outer surface of the core cowl 30 are treated with an acoustic structure of the type illustrated in U.S. Pat. No. 4,254,171. It is to be seen that the acoustically treated surfaces have arcuate and compound curved shapes.

Figure 3:
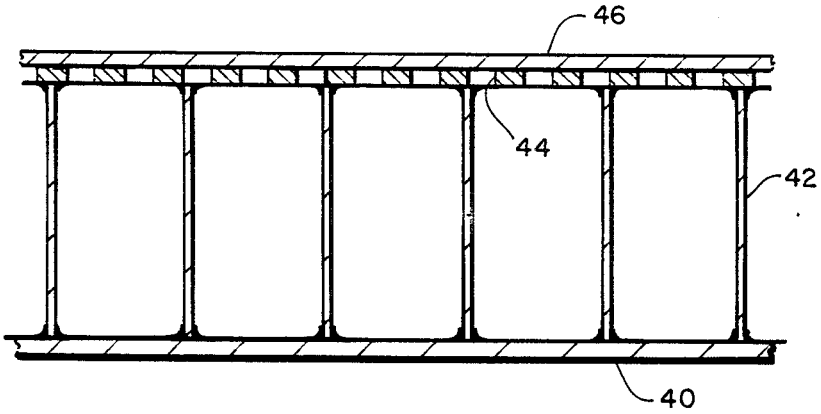
FIG. 3 is a fragmentary vertical section of a sound attenuation structure using perforate sheet made by use of the present invention.

Referring now to FIG. 3, it will be seen that the acoustic treatment described for FIG. 2 typically includes a solid back skin 40 and a cellular honeycomb core 42 that is adhesively bonded to the back skin 40 and a perforated face skin 44. Generally, one or more of the elements 40, 42 and 44 are made of a metal such as aluminum. The perforated face skin 44 has adhesively bonded to it a microporous overlay 46 which may be made from a stainless steel cloth. The various adhesive layers space elements 40, 42, 44 and 46 from each other to preclude any possible galvanic action.

The face skin 44, the manufacture of which is what this invention pertains to, is typically 0.03"–0.04" thick and provided with a plurality of small apertures that are arranged in a predetermined spacing and according to a predetermined pattern. The pattern, by way of example, may comprise 0.125" diameter holes that are arranged in a square or diamond pattern and are suitably and uniformly spaced apart to provide a 34 POA.

As aforementioned, the invention is directed to forming of precision essentially parallel walled apertures through an advanced composite material including resin matrix fiber reinforced composites, carbon/carbon composites, fiberglass, and the like by means of grit blasting.

Figure 4:
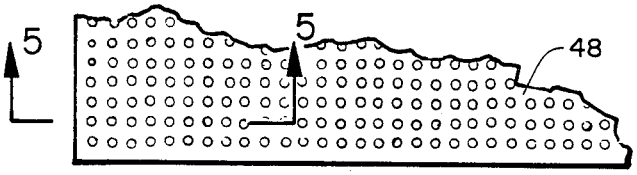
FIG. 4 is a top view showing of a maskant section having a selected design pattern for use as a pattern for perforating a solid workpiece with precision apertures with the maskant adhered to a flat section of workpiece.
Figure 5:
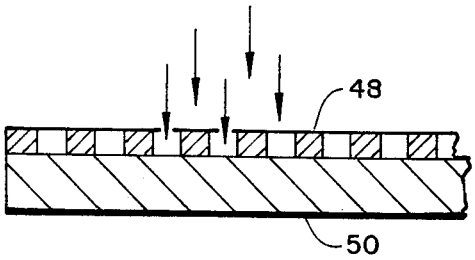
FIG. 5 is a side view showing of a solid compound contoured workpiece to which the maskant of FIG. 4 is adhered for producing the maskant pattern therethrough.
Figure 5A:
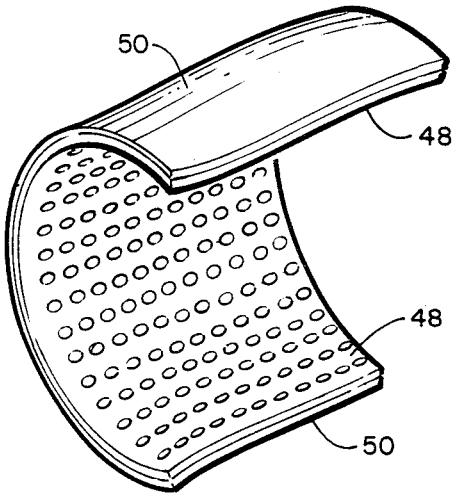
FIG. 5A illustrates a typical compound, contour workpiece of the same condition.

Referring now to FIGS. 4, 5, and 5A, FIG. 4 is a top view showing of a maskant 48 formed from a sheet of material resistive to grit blast directed toward its non perforated surface. The material 48 may be polyurethane, vinyl or the like. A basic requirement is that the maskant material be resistive to the force of the intended grit blast and remain as an integral sheet so that it can be adhered to the workpiece prior to grit blasting, remain intimately adhered to the workpiece during and removed from the workpiece after the perforating of the workpiece according to the maskant pattern is completed.

In addition, the maskant must have tensile strength and elongation characteristics that allow it to be conformed to the compound contour of the workpiece without unacceptable distortion of the perforate pattern due to localized stretching. The method of adhering the maskant must retain it in place on the compound contour without pulling away prior to or during grit blasting.

Initially the workpiece in the form of an uncured advanced composite sheet is selected and laid up in a procured condition and formed to a predetermined shape and size. The formed part is then cured to a final shape by subjecting the part to appropriate heat and pressure. As will be apparent to those skilled in the art, this involves placing the part in appropriate tooling and, with the use of suitable vacuum bagging, subjecting the part to a desired aspect heat and pressure cycle within a suitable autoclave. The specific forming and curing of the part will depend on the particular advanced composite chosen.

The desired opening pattern and sizes are formed in the maskant 48 by any selected convenient means such as drilling, cutting, laser burning etc. The maskant 48 is then strippingly adhered to the part 50 as shown in FIGS. 4, 5 and 5A. A venturi type nozzle, that is a nozzle with a slight outward diverging conic exit; or a straight nozzle with a tubular exit is used to blast a mixture of air and abrasive grit at the part 50. The nozzle orifice size is in the range of 3/16" to ½" with a maximum conic exit taper of approximately 8°. The nozzle is then held at a suitable distance from the workpiece and typically perpendicular to the workpiece. The workpiece to be perforated in this application typically has a thickness of from 0.030" to 0.10". Grit material typically, but not limited to, having a particle size distribution selected from a commercial grit (No. 240 through No. 60) is forced through the nozzle under a pressure, in the range of but not limited to, 70 to 100 psi by conventional means, such as dried and filtered compressed air, nitrogen, carbon dioxide or the like.

The grit stream leaving the nozzle impacts the maskant 48 and the part 50 through the maskant opening with an impingement pattern of concentrated particle flux having a diameter of approximately ½" to 2" depending upon the nozzle size and distance from the workpiece. The diameter of the concentrated particle flux provides abrasive impingement through several maskant openings simultaneously to contribute to the cutting speed of the process. The abrasive feed can range from 200 to 2000 pounds per hour depending upon nozzle orifice size and operating pressure to provide high cutting speeds (not obtainable with abrasive jet machining referenced in the prior art). The nozzle is played over the entire perforated maskant 48 or the workpiece is moved beneath the nozzle until the maskant 48 patter is perforated through the composite material 50 beneath. The abrasive feed rate, abrasive material and grit size, nozzle operating pressure, nozzle and/or workpiece, travel speed, stand-off distance and nozzle orifice size must be carefully selected and controlled to prevent premature maskant failure during perforation of the composite material at reasonable production rates.

Figure 8:
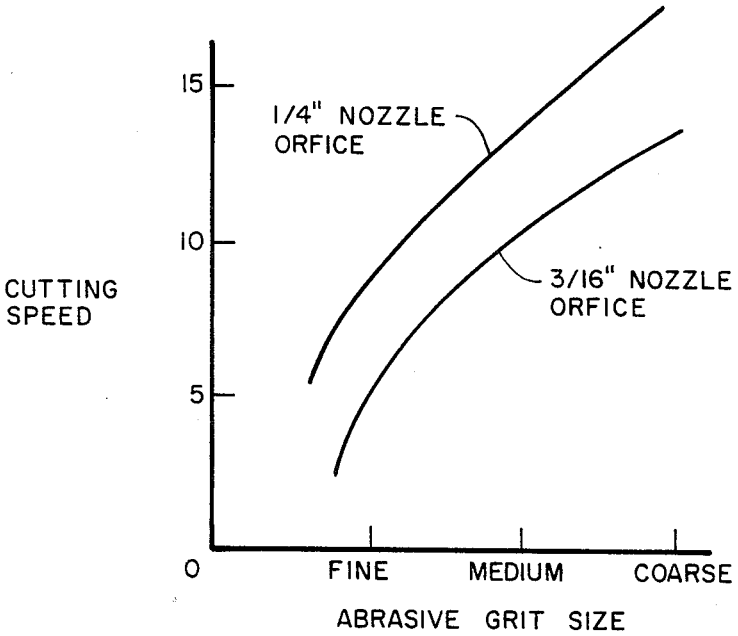
FIG. 8 is a plot of cutting speed versus abrasive grit size for two different sizes of nozzle orifice.

FIG. 8 shows the effect of nozzle orifice size and abrasive grit size on cutting speed, other parameters held constant. It is noted that cutting speed drops off rapidly in the smaller particle size range. Nozzle operating pressure, abrasive feed rate and nozzle stand-off distance can also influence cutting speed to a significant degree. It is obvious that one schooled in the instant art can provide an equivalent high cutting speed by various combinations of operating pressure, nozzle orifice size, grit size, stand-off distance, etc.

While abrasive jet machining with a very fine abrasive provides cutting speeds (without maskant) in the range of 20–40 milligrams per minute, the instant invention can provide cutting speeds (with maskant) of at least 10–20 grams per minute, that is approximately a 500 times faster cutting speed.

In the erosion lithography teaching a suction nozzle blasting system is taught. In the present invention; either a suction nozzle blasting system or a non-suction nozzle pressure blasting machine system may be utilized. The latter system providing at least twice the cutting speed of the suction nozzle system.

The perforations formed by the grit stream can be controlled to have a taper on the wall surfaces of not more than approximately 8° from the center line of the nozzle. This is a relatively small taper and does not effect the material in its ultimate configuration or operation.

Figure 6:
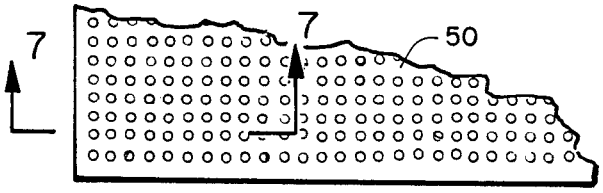
FIG. 6 is a top view of the solid flat workpiece section of FIG. 4 after the desired aperture pattern has been grit blasted through the workpiece and the maskant removed.
Figure 7:
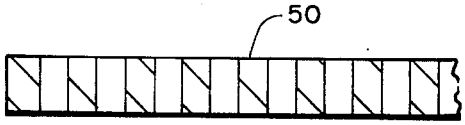
FIG. 7 is a side view of the workpiece shown in FIG. 6 and in the same state.

When the perforating is completed (see FIGS. 6 and 7), the maskant 48 is removed from the workpiece 50 by stripping. The resulting workpiece is substantially ready at this stage for its ultimate use. In the particular application described the part 50 could then be cleaned and adhesively bonded into a sound attenuation structure of the type illustrated in FIG. 3 hereof.

It has been found that highly abrasive grit materials, such as aluminum oxide, silicon carbide and the like may be used to practice the invention.

Figure 9:
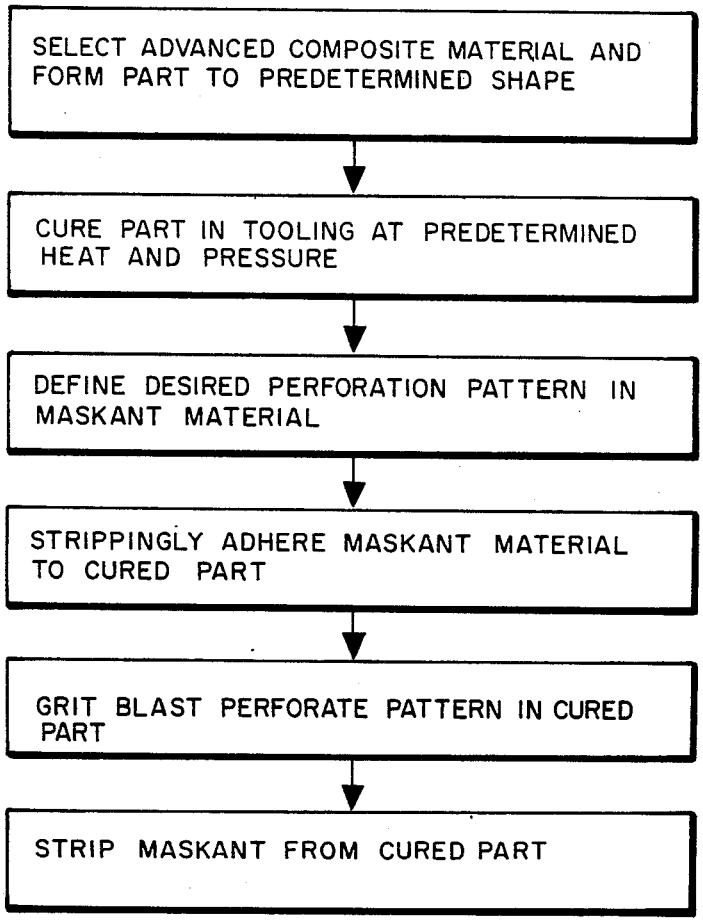
FIG. 9 is a simplified flow chart illustrating the steps of the method of the present invention.
Figure 10:
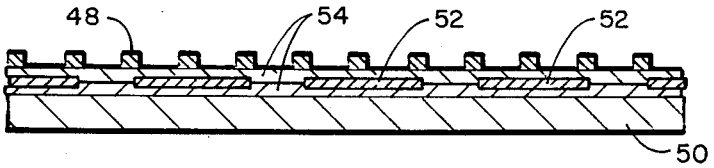
FIG. 10 is a side view of a maskant section located over a workpiece in corporating a configured foil and insulation layers.

In FIG. 10, it will be seen that it is also possible to provide a part 50 which has a configurated foil 52, for example, co-cured, laminated or bonded to it with insulation layers 54 prior to the application of the method of FIG. 9 that has just been described. Foil 52 may, for example, be composed of a suitable metal that with the application thereto of suitable electric power when the components 50, 52 and 54 of FIG. 9 is incorporated in the sound attenuation structure of FIG. 3 provide an acoustically active deicing capability that would be particularly adapted for use in acoustic inlets of jet engines.

Other embodiments of the invention may require perforation of the workpiece at a controlled angle or angles other than essentially perpendicular to the workpiece surface or with controlled but different entry/exit hole diameters. The former being controlled by orientation of the nozzle centerline relative to the workpiece surface, and the latter by drilling time.

While the particular application of the invention as described relates specifically to the grit blasting of a plurality of spaced apart apertures arranged in a specific pattern in an advanced composite sheet for incorporation in a sound attenuation structure particularly adapted for use in nacelle systems of aircraft jet engines, it would be susceptible to use in other applications that require the provision of a plurality of precision apertures having essentially parallel sided walls in a tough brittle part that may be subject to being shaped in a variety of sizes and shapes. With respect to nacelle systems in particular, the invention can be used to cut precisely shaped access door openings, or to cut precise edges in advanced composite curved or compound curved elements of the nacelle such as inlet or fan cowls. The rapid perforation of circuit boards would be an obvious application. The perforation of light weight truss structure elements for satellite antennas and the like would be another application.

It will be obvious that the invention may be carried out in many different specific forms and it will be further evident that many different specific variants of the method may be employed. The invention is consequently to be considered as embracing all forms of apparatus and variants of methods falling within the scope of the appended claims.

What is claimed is:

1. A method of forming perforations in contoured resin matrix fiber reinforced advanced composite materials for use in sound attenuation structures for aircraft surfaces, comprising the steps of:

providing a sheet of imperforate contoured resin matrix fiber reinforced advanced composite material for use in sound attenuation structures for aircraft surfaces;

forming a mask having an aperture pattern thereon, the apertures having a diameter in the range of from about 0.010" to about 0.250";

positioning said mask to follow the contour of a surface of said sheet and then releasably adhering said mask to said surface of said sheet;

providing a grit having the capability of blasting through said sheet while retaining said mask on said sheet, said grit having a particle grit number range of from about 60 to about 240 grit;

blasting said grit against said mask at a pressure in the range of from about 70 to 100 pounds per square inch at an angle of from 0 degrees to about 8 degrees relative to the walls of the apertures in said mask to form apertures in said sheet at the locations of said apertures; and removing said mask.

2. The method of claim 1 wherein the aperture pattern is a predetermined aperture pattern.

3. The method of claim 1 wherein the apertures typically provide a per cent open area ranging in value from 4 to 34.

4. The method as defined in claim 1 wherein said mask is formed of polyurethane material.

5. The method as defined in claim 1 wherein said mask is adhered to said composite material.

6. The invention as defined in claim 1 wherein said mask is formed of a vinyl material or rubber base material.

7. The invention as defined in claim 1 wherein the perforated structure has a thickness of from 0.005 to 0.250 inchess.

8. The invention as defined in claim 1 wherein said grit material is aluminum oxide, silicon carbide or the like having dense, hard, sharp, abrasive grains.

9. A perforated structure manufactured according to the method of claim 1.

10. The method as defined in claim 1 wherein the grit blasting is performed with either a suction nozzle blasting system or a non-suction nozzle pressure blasting machine system.

* * * * *